US011698654B2

(12) United States Patent
Yamamoto

(10) Patent No.: US 11,698,654 B2
(45) Date of Patent: Jul. 11, 2023

(54) BUTTON DEVICE AND TIMEPIECE

(71) Applicant: CASIO COMPUTER CO., LTD., Tokyo (JP)

(72) Inventor: Keishirou Yamamoto, Kokubunji (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 395 days.

(21) Appl. No.: 17/021,208

(22) Filed: Sep. 15, 2020

(65) Prior Publication Data

US 2021/0089072 A1 Mar. 25, 2021

(30) Foreign Application Priority Data

Sep. 19, 2019 (JP) ..... 2019-170368

(51) Int. Cl.
*G05G 1/02* (2006.01)
*G04C 3/00* (2006.01)
(Continued)

(52) U.S. Cl.
CPC ..... *G05G 1/025* (2013.01); *G04C 3/001* (2013.01); *G04G 21/00* (2013.01); *G04B 3/001* (2013.01);
(Continued)

(58) Field of Classification Search
CPC ..... G05G 1/025; G05G 1/02; G05G 25/04; G04G 21/00; G04G 21/08; G04C 3/001;
(Continued)

(56) References Cited

U.S. PATENT DOCUMENTS 3,946,182 A * 3/1976 Holder ..... H01H 13/14 368/224
3,952,176 A * 4/1976 Holder ..... H01H 25/06 200/11 R
(Continued)

FOREIGN PATENT DOCUMENTS

CN 102957271 A 3/2013
JP 2000346960 A 12/2000
(Continued)

OTHER PUBLICATIONS

Japanese Office Action (and English language translation thereof) dated Nov. 25, 2021, issued in counterpart Japanese Application No. 2019-170368.
(Continued)

*Primary Examiner* — Edwin A. Leon
(74) *Attorney, Agent, or Firm* — Holtz, Holtz & Volek PC

(57) ABSTRACT

To prevent an erroneous operation and improve operability, a button device and a timepiece including the button device are provided. The button device includes: a cylindrical first guide protector 11 protruding from the lateral face of a wristwatch case 1; and a first button 12 disposed in the first guide protector 11 to be slidable inward and outward of the wristwatch case 1. The first button 12 includes a first button head 13 disposed in the first guide protector 11, and a first button shaft 15 passing through a first through hole 14 of the wristwatch case 1. The first button head 13 is inclined obliquely upward relative to the lateral face of the wristwatch case 1. The first guide protector 11 protects the outer periphery of the first button head 13, and this prevents accidental and erroneous operation of the first button 12. The first button head 13 is inclined obliquely upward relative to the lateral face of the wristwatch case 1, and this allows the user to easily place a fingertip on the outer end face of the
(Continued)

first button head 13, and so improves the operability of the first button 12.

21 Claims, 6 Drawing Sheets

(51) Int. Cl.

| | |
|---|---|
| ***G04G 21/00*** | (2010.01) |
| ***G04B 3/04*** | (2006.01) |
| ***G04B 37/10*** | (2006.01) |
| ***G04G 21/08*** | (2010.01) |
| ***G04B 3/00*** | (2006.01) |

(52) U.S. Cl.
CPC ..... *G04B 3/048* (2013.01); *G04B 37/106* (2013.01); *G04C 3/005* (2013.01); *G04C 3/008* (2013.01); *G04G 21/08* (2013.01)

(58) Field of Classification Search
CPC ..... G04C 3/005; G04C 3/008; G04B 37/106; G04B 3/048; G04B 3/001; H01H 25/06; H01H 2300/016; H01H 13/14
See application file for complete search history.

(56) References Cited

U.S. PATENT DOCUMENTS

| | | | | |
|---|---|---|---|---|
| 7,419,297 | B2 * | 9/2008 | Noirjean ..... | G04C 3/001 368/69 |
| 9,086,684 | B2 | 7/2015 | Sakurasawa | |
| 2016/0365203 | A1 | 12/2016 | Hidai | |

FOREIGN PATENT DOCUMENTS

| | | | |
|---|---|---|---|
| JP | 2006266987 | A | 10/2006 |
| JP | 3132691 | U | 6/2007 |
| JP | 2016223933 | A | 12/2016 |
| JP | 2017004828 | A | 1/2017 |

OTHER PUBLICATIONS

Chinese Office Action (and English language translation thereof) dated Jul. 21, 2021, issued in Chinese Application No. 202010990350.2.

* cited by examiner

BUTTON DEVICE AND TIMEPIECE

CROSS-REFERENCE TO RELATED APPLICATIONS

This application is based upon and claims the benefit of priority under 35 USC 119 of Japanese Patent Application No. 2019-170368 filed on Sep. 19, 2019, the entire disclosure of which, including the description, claims, drawings, and abstract, is incorporated herein by reference in its entirety.

BACKGROUND OF THE INVENTION

1. Field of the Invention

The present invention relates to button devices and timepieces including such a button device.

2. Description of the Related Art

Timepieces having a plurality of button devices on the lateral face of the case have been known as described in JP 2017-4828, for example.

This type of button device has a button shaft slidably inserted into a through hole in a lateral part of the case, and a button head at an outer end of the button shaft, the button head being disposed substantially parallel to the lateral part of the case. The button head is disposed to protrude from and retract into a recess in the lateral part of the case.

BRIEF SUMMARY OF THE INVENTION

A button device includes: a case having a lateral face and a guide protector protruding from the lateral face of the case; and a button disposed in the guide protector to be slidable, the button including: a button head disposed in the guide protector; and a button shaft passing through a hole in the case, the button head being inclined obliquely upward relative to the lateral face of the case.

DETAILED DESCRIPTION OF THE INVENTION

The following describes a wristwatch as one embodiment of the present invention, with reference to FIG. 1 to FIG. 6.

Figure 1:
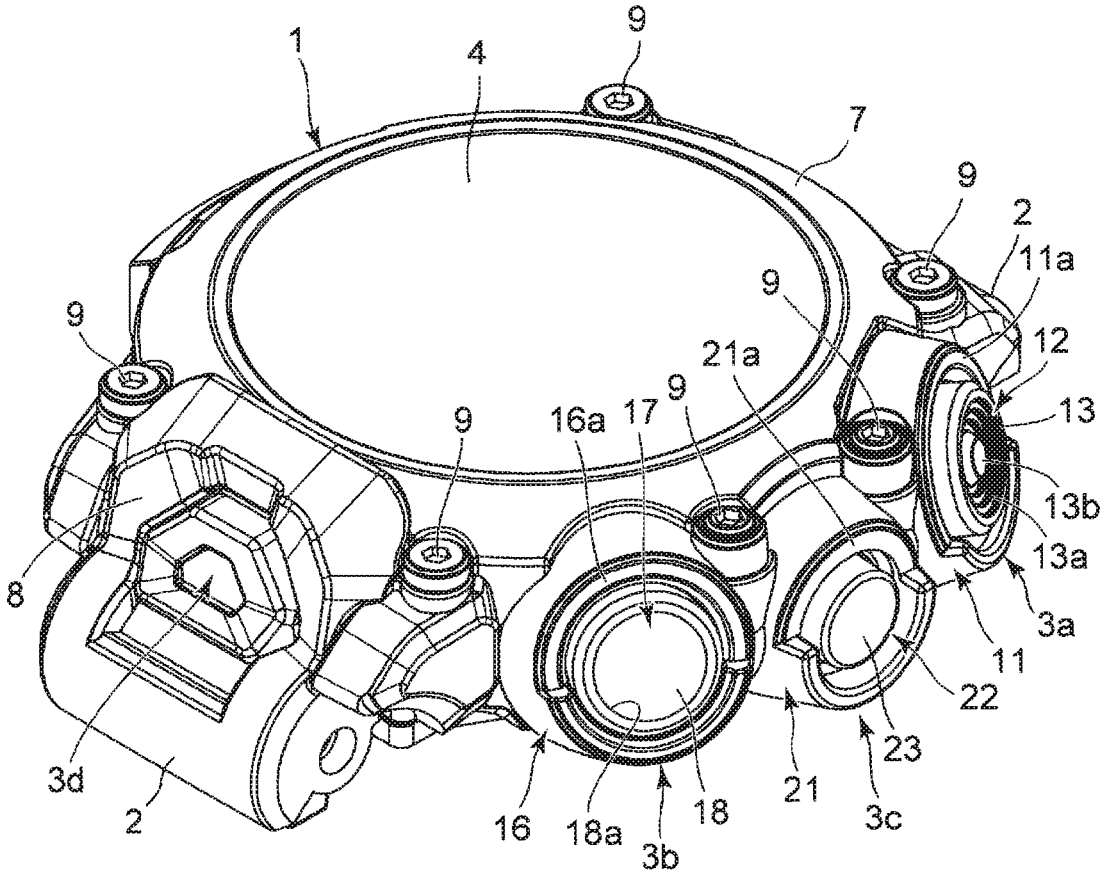
FIG. 1 is an enlarged perspective view of a wristwatch that is one embodiment of the present invention.
Figure 2:
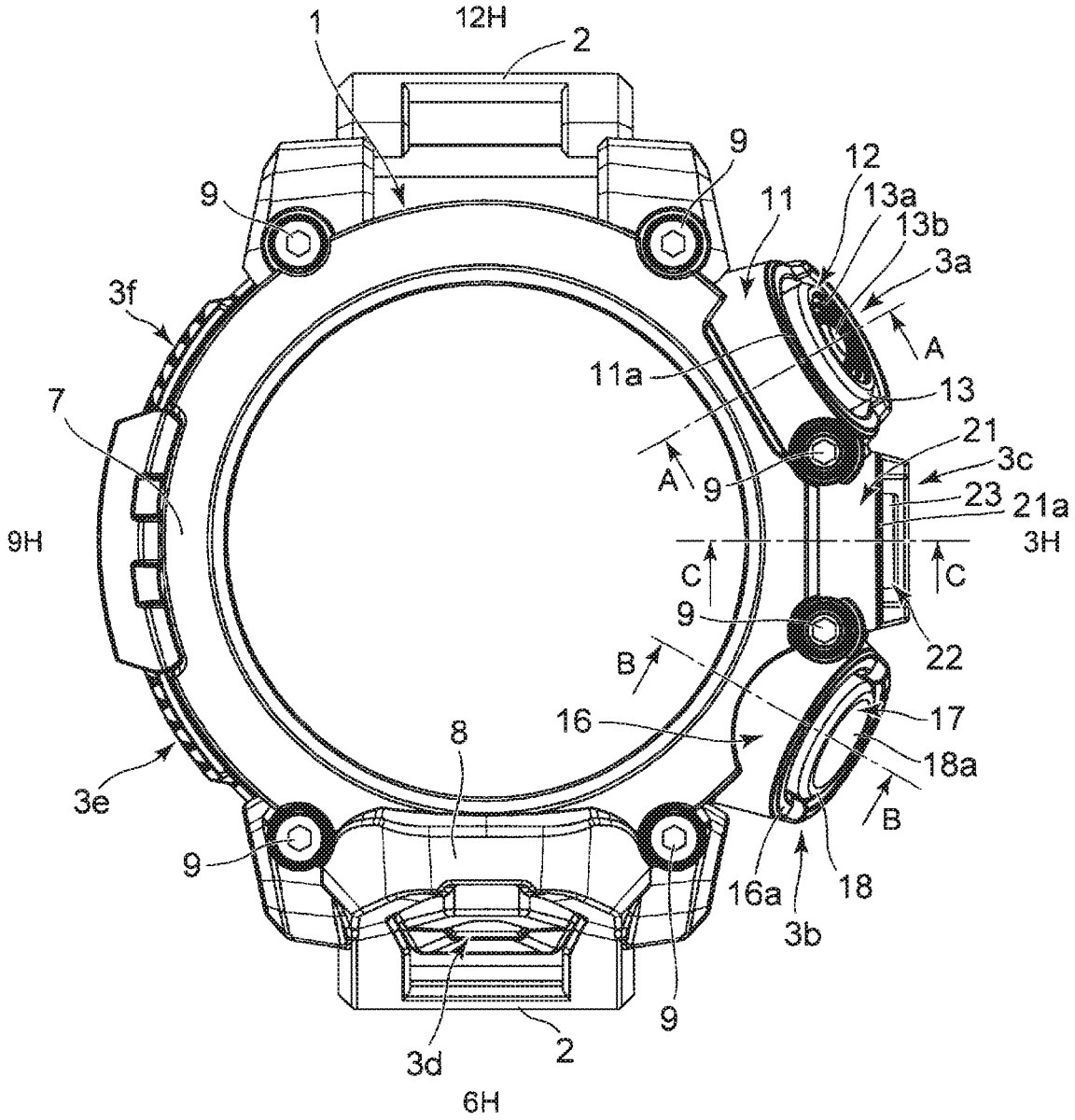
FIG. 2 is an enlarged front view of the wristwatch of FIG. 1.

As illustrated in FIG. 1 and FIG. 2, the wristwatch includes a wristwatch case 1. This wristwatch case 1 includes band attachment portions 2, to which a band (not illustrated) is attached, at a 12 o'clock position and a 6 o'clock position. The present embodiment refers to a part of the wristwatch case 1 where a glass 4 described later is attached as the upper part, and refers to a part of the wristwatch case 1 where a bottom lid 5 described later is attached as the lower part.

Figure 4:
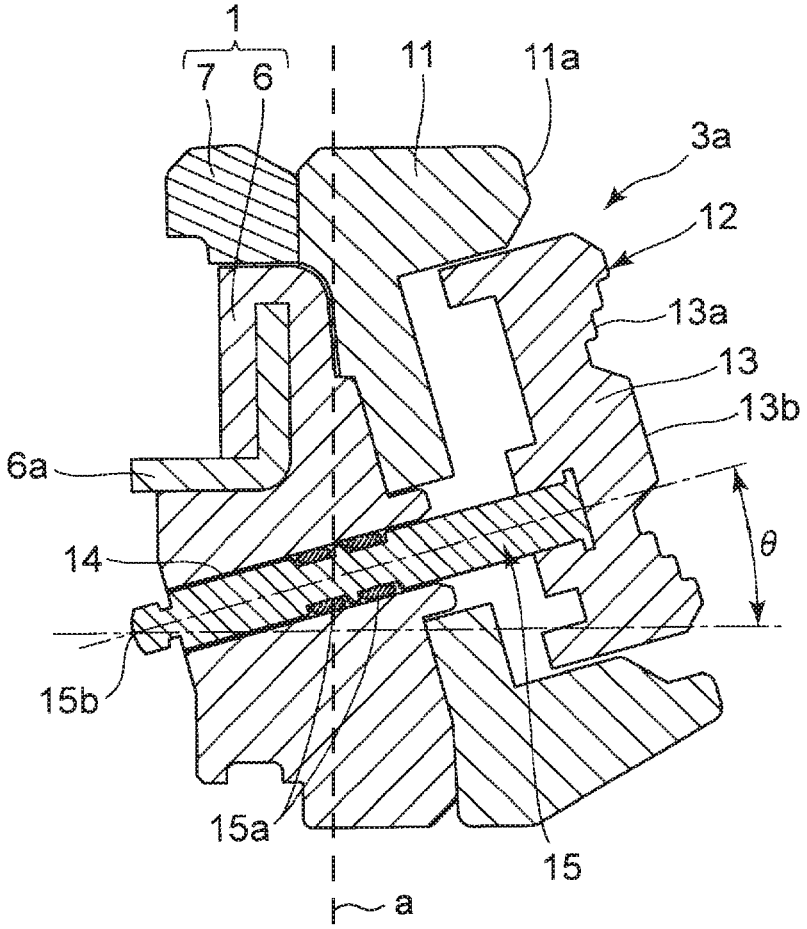
FIG. 4 is an enlarged cross-sectional view of a major part of the button device at the 2 o'clock position taken along the line A-A of the wristwatch of FIG. 2.
Figure 5:
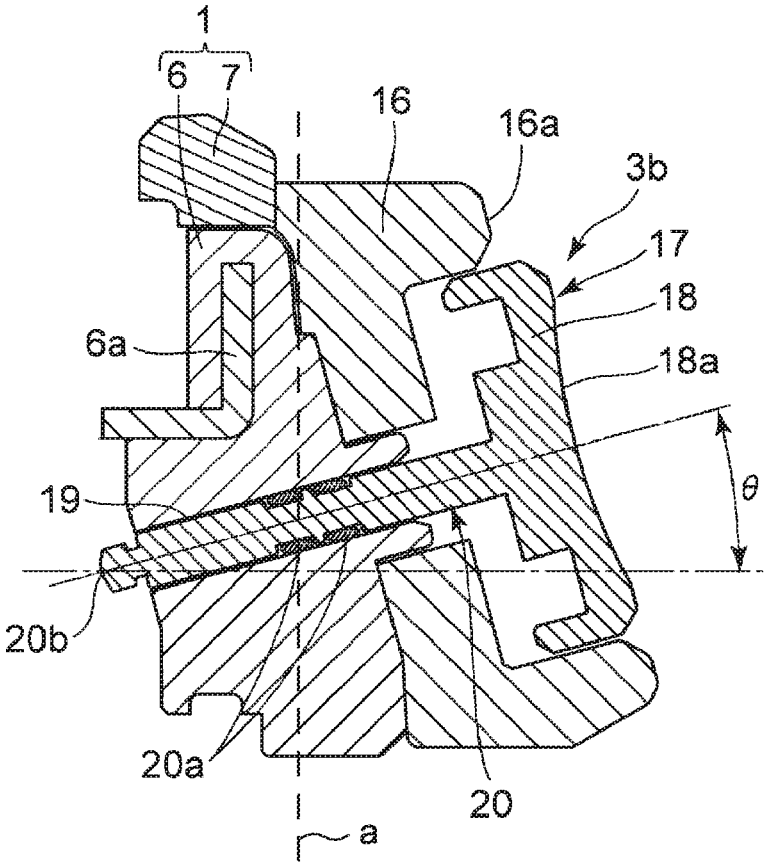
FIG. 5 is an enlarged cross-sectional view of a major part of the button device at the 4 o'clock position taken along the line B-B of the wristwatch of FIG. 2.
Figure 6:
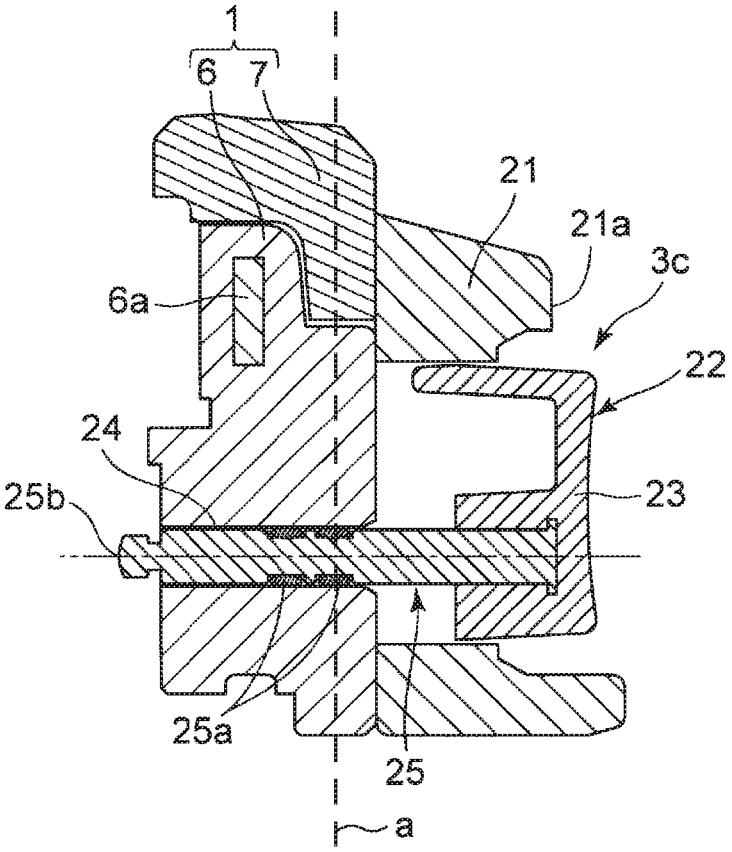
FIG. 6 is an enlarged cross-sectional view of a major part of the button device at the 3 o'clock position taken along the line C-C of the wristwatch of FIG. 2.

A lateral face of the wristwatch case 1 of the present embodiment refers to an imaginary face perpendicularly intersecting the glass 4 as indicated with line a in FIG. 4, FIG. 5 and FIG. 6.

Figure 3:
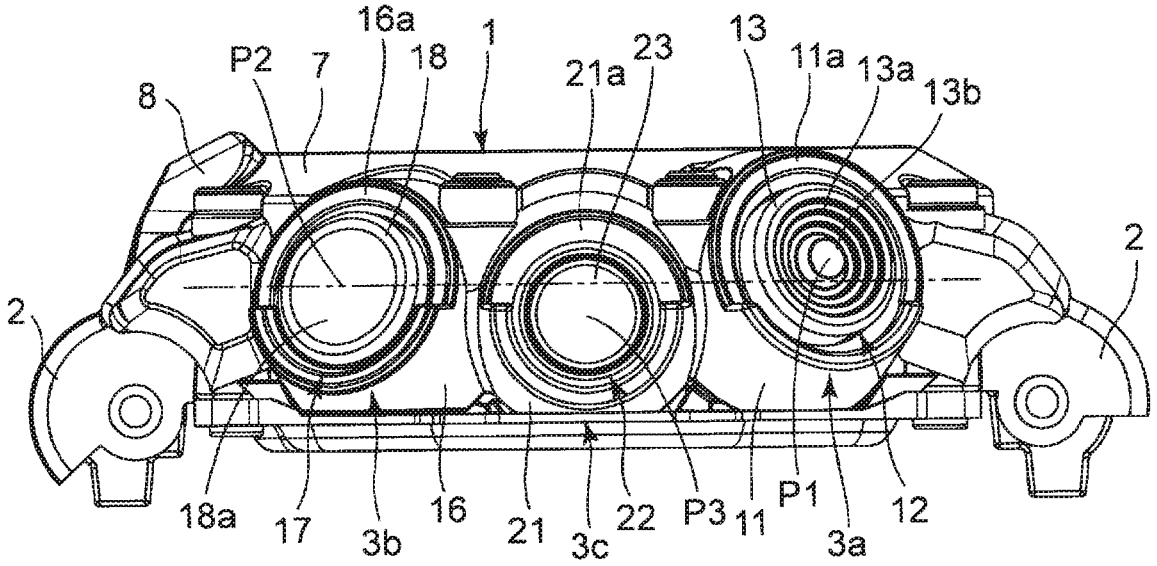
FIG. 3 is an enlarged side view of the wristwatch of FIG. 2, illustrating a lateral face at the 3 o'clock position.

As illustrated in FIG. 1 and FIG. 2, the wristwatch 1 includes button devices 3*a* to 3*f* at a 2 o'clock position, a 3 o'clock position, a 4 o'clock position, a 6 o'clock position, a 8 o'clock position and a 10 o'clock position, respectively. This wristwatch case 1 has an upper opening, to which the glass 4 is attached. As illustrated in FIG. 3, the bottom lid 5 is attached to the lower part of the wristwatch case 1. This wristwatch case 1 internally includes a watch module (not illustrated).

As illustrated in FIGS. 1 to 6, the wristwatch case 1 in this embodiment includes a main body case 6, an outer case 7, and a cover member 8, and has a substantially round shape as a whole. The main body case 6 is made of hard synthetic resin, and has a reinforcing portion 6*a* made of metal that is internally embedded. The outer case 7 is made of resin, such as carbon or urethane, or a metal, such as stainless steel, and is attached to the main body case 6 with a plurality of screws 9 so as to cover the upper outer periphery of the main body case 6.

As illustrated in FIGS. 1 to 6, the cover member 8 is made of synthetic resin, such as urethane. This cover member 8 is disposed at a 6 o'clock position on the lateral face of the wristwatch case 1, and is attached to the main body case 6 with a plurality of screws 9.

Among the plurality of button devices 3*a* to 3*f*, the first button device 3*a* located at the 2 o'clock position of the wristwatch case 1, the second button device 3*b* located at the 4 o'clock position of the wristwatch case 1, and the third button device 3*c* located at the 3 o'clock position of the wristwatch case 1 are disposed on the lateral part of the wristwatch case 1 side by side on the lateral face as illustrated in FIGS. 1 to 3.

As illustrated in FIG. 3, the first to third button devices 3*a* to 3*c* in this embodiment are vertically displaced on the lateral part of the wristwatch case 1. Specifically the first to third button devices 3*a* to 3*c* are arranged relative to the second button device 3*b* so that the first button device 3*a* is located slightly above the second button device 3*b* on the lateral part of the wristwatch case 1, and the third button device 3*c* is located slightly below the second button device 3*b* on the lateral part of the wristwatch case 1.

As illustrated in FIGS. 1 to 4, the first button device 3*a* at the 2 o'clock position includes a substantially cylindrical first guide protector 11 protruding from the main body case 6 at the 2 o'clock position, and a first button 12 disposed in the first guide protector 11 so as to be slidable inward and outward of the wristwatch case 1. The first guide protector 11 is located slightly above the second button device 3*b* on the lateral face of the wristwatch case 1, and is disposed on the main body case 6 while being slightly inclined upward.

As illustrated in FIGS. 1 to 4, the first guide protector 11 protrudes radially in the direction from the center of the wristwatch case 1 toward the 2 o'clock position of the lateral part of the wristwatch case 1 in plan view. This first guide protector 11 has a first step portion 11*a* at the outer peripheral end protruding from the outer case 7. Specifically the first step portion 11*a* is disposed at the outer peripheral end of the first guide protector 11 so that almost upper half above the first step portion protrudes less than almost lower half on the lateral face of the wristwatch case 1.

As illustrated in FIGS. 1 to 4, the first button 12 includes a first button head 13 disposed in the first guide protector 11, and a first button shaft 15 passing through a first through hole 14 in the main body case 6 of the wristwatch case 1. The first button head 13 has a substantially disk shape. This first button head 13 has a first recess 13*a* on the outer end face to be recessed in an arc shape toward the inside of the wristwatch case 1, and has a small protrusion 13*b* at a center part of the first recess. This small protrusion 13*b* lets a user know the position with their fingertip.

As illustrated in FIGS. 1 to 4, the first button head 13 in this embodiment is inclined obliquely upward relative to the lateral face of the wristwatch case 1. The first guide protector 11 also is inclined obliquely upward toward the outside relative to the lateral face of the wristwatch case 1 according to the inclination of the first button head 13.

This means that the first button head 13 is configured to slide obliquely in the first guide protector 11 while having an obliquely inclined state.

As illustrated in FIG. 4, the first button shaft 15 comes with a plurality of first waterproof rings 15*a* on the outer peripheral face, and is slidably inserted into the first through hole 14 in the main body case 6 of the wristwatch case 1 via the plurality of first waterproof rings 15*a*. The first button shaft 15 is inclined obliquely upward toward the outside relative to the lateral face of the wristwatch case 1 with a predetermined inclination angle θ, e.g., of about 15° according to the inclination of the first button head 13.

In other words, as illustrated in FIG. 4, the first button shaft 15 has a predetermined inclination angle θ relative to the lateral face of the wristwatch case 1, so that the first button shaft 15 is substantially orthogonal to the inner end face of the first button head 13. To this end, the first through hole 14 is inclined relative to the main body case 6 of the wristwatch case 1 with the same inclination angle θ as the first button shaft 15.

As illustrated in FIG. 2, the first button shaft 15 extends radially in plan view in the direction from the center part of the wristwatch case 1 toward the 2 o'clock position at the lateral part of the wristwatch case 1.

As illustrated in FIG. 4, the first button shaft 15 is displaced downward from the center part of the inner end face of the first button head 13 on the lateral face of the wristwatch case 1.

As illustrated in FIGS. 1 to 3 and 5, the second button device 3*b* at the 4 o'clock position includes a substantially cylindrical second guide protector 16 protruding from the main body case 6 at the 4 o'clock position, and a second button 17 disposed in the second guide protector 16 so as to be slidable inward and outward of the wristwatch case 1.

As illustrated in FIGS. 1 to 3 and 5, the second guide protector 16 is located slightly below the first button device 3*a* and slightly above the third button device 3*c* on the lateral face of the wristwatch case 1, and is disposed on the main body case 6 while being slightly inclined upward. This second guide protector 16 protrudes radially in the direction from the center part of the wristwatch case 1 toward the 4 o'clock position of the wristwatch case 1 in plan view.

As illustrated in FIGS. 1 to 3 and 5, the second guide protector 16 has an inner diameter substantially equal to the inner diameter of the first guide protector 11. The second guide protector 16 in this embodiment has a second step portion 16*a* at the outer peripheral end protruding from the outer case 7, similarly to the first step portion 11*a*. Specifically the second step portion 16*a* is disposed at the outer peripheral end of the second guide protector 16 so that almost upper half above the second step portion protrudes less than almost lower half on the lateral face of the wristwatch case 1.

As illustrated in FIGS. 1 to 3 and 5, the second button 17 includes a second button head 18 disposed in the second guide protector 16, and a second button shaft 20 passing through a second through hole 19 in the main body case 6 of the wristwatch case 1. This second button head 18 has a substantially disk shape of a substantially same size as the first button head 13. Similarly to the first button head 13, the second button head 18 has a second recess 18*a* on the outer end face to be recessed in an arc shape toward the inside of the wristwatch case 1.

Similarly to the first button head 13, the second button head 18 in this embodiment is inclined obliquely upward relative to the lateral face of the wristwatch case 1 as illustrated in FIGS. 1 to 3 and 5. Similarly to the first guide protector 11, the second guide protector 16 also is inclined obliquely upward toward the outside relative to the lateral face of the wristwatch case 1 according to the inclination of the second button head 18. This means that the second button head 18 is configured to slide obliquely in the second guide protector 16 while having an obliquely inclined state.

As illustrated in FIG. 5, the second button shaft 20 comes with a plurality of second waterproof rings 20*a* on the outer peripheral face similarly to the first button shaft 15, and is slidably inserted into the second through hole 19 in the main body case 6 of the wristwatch case 1 via the plurality of second waterproof rings 20*a*. This second button shaft 20 is inclined obliquely upward toward the outside relative to the lateral face of the wristwatch case 1 according to the inclination of the second button head 18 with a predetermined inclination angle, i.e., the same inclination angle θ as the first button shaft 15, e.g., of about 15°.

In other words, as illustrated in FIG. 5, the second button shaft 20 has a predetermined inclination angle θ relative to the lateral face of the wristwatch case 1, so that the second button shaft 20 is substantially orthogonal to the inner end face of the second button head 18. To this end, the second through hole 19 is inclined relative to the main body case 6 of the wristwatch case 1 with the same inclination angle θ as the second button shaft 20.

As illustrated in FIG. 2, the second button shaft 20 extends radially in plan view in the direction from the center part of the wristwatch case 1 toward the 4 o'clock position at the lateral part of the wristwatch case 1. As illustrated in FIG. 5, the second button shaft 20 is located at a center part of the inner end face of the second button head 18.

This means that, as illustrated in FIG. 3, the first button 12 and the second button 17 have the first center part P1 of the end face of the first button head 13 and the second center part P2 of the outer end face of the second button head 18, respectively, that are vertically displaced on the lateral face of the wristwatch case 1. Specifically the first center part P1 of the outer end face of the first button head 13 in the first button 12 is located above the second center part P2 of the outer end face of the second button head 18 in the second button 17.

As illustrated in FIGS. 1 to 3 and 6, the third button device 3*c* at the 3 o'clock position includes a substantially cylindrical third guide protector 21 protruding from the main body case 6 at the 3 o'clock position, and a third button 22 disposed in the third guide protector 21 so as to be slidable inward and outward of the wristwatch case 1.

As illustrated in FIGS. 1 to 3 and 6, the third guide protector 21 is located slightly below the second button device 3*b* on the lateral face of the wristwatch case 1. This third guide protector 21 protrudes radially in the direction from the center part of the wristwatch case 1 toward the 3 o'clock position of the wristwatch case 1 in plan view. This third guide protector 21 has an inner diameter that is smaller than the inner diameters of the first and second guide protectors 11 and 16.

As illustrated in FIGS. 1 to 3 and 6, the third guide protector 21 has a third step portion 21*a* at the outer peripheral end protruding from the outer case 7 similarly to the first and second step portions 11*a* and 16*a*. Specifically the third step portion 21*a* is disposed at the outer peripheral end of the third guide protector 21 so that almost upper half above the third step portion protrudes less than almost lower half on the lateral face of the wristwatch case 1.

As illustrated in FIGS. 1 to 3 and 6, the third button 22 includes a third button head 23 disposed in the third guide protector 21, and a third button shaft 25 passing through a third through hole 24 in the main body case 6 of the wristwatch case 1. The third button head 23 has a substantially disk shape with an outer diameter that is smaller than those of the first and second button heads 13 and 18. The outer end face of the third button head 23 is substantially flat.

As illustrated in FIGS. 1 to 3 and 6, the third button head 23 in this embodiment is placed substantially parallel to the lateral face of the wristwatch case 1. This means that the inner peripheral face of the third guide protector 21 is substantially orthogonal to the lateral face of the wristwatch case 1. This means that the third button head 23 is configured to slide in the third guide protector 21 in the direction substantially orthogonal to the lateral face of the wristwatch case 1 while having a substantially parallel state relative to the lateral face of the wristwatch case 1.

As illustrated in FIG. 6, the third button shaft 25 comes with a plurality of third waterproof rings 25*a* on the outer peripheral face, and is slidably inserted into the third through hole 24 in the main body case 6 of the wristwatch case 1 via the plurality of third waterproof rings 25*a*. The third button head 23 of the third button shaft 25 is placed substantially parallel to the lateral face of the wristwatch case 1, which means that the third button shaft 25 is substantially orthogonal to the lateral face of the wristwatch case 1.

In other words, as illustrated in FIG. 6, the third button shaft 25 is substantially orthogonal to the lateral face of the wristwatch case 1, so that the third button shaft 25 is substantially orthogonal to the inner end face of the third button head 23. To this end, similarly to the third button shaft 25, the third through hole 24 is substantially orthogonal to the lateral face of the main body case 6 of the wristwatch case 1.

As illustrated in FIG. 6, similarly to the first button shaft 15, the third button shaft 25 in this embodiment is displaced downward from the center part of the inner end face of the third button head 23 on the lateral face of the wristwatch case 1. This means that, as illustrated in FIG. 3, the first through third buttons 12, 17, and 22 have the first center part P1 of the outer end face of the first button head 13, the second center part P2 of the outer end face of the second button head 17, and the third center part P3 of the outer end face of the third button head 23, respectively, that are vertically displaced on the lateral face of the wristwatch case 1.

That is, as illustrated in FIG. 3, the first center part P1 of the outer end face of the first button head 13 in the first button 12 is located above the second center part P2 of the outer end face of the second button head 18 in the second button 17. The third center part P3 of the outer end face of the third button head 23 in the third button 22 is located below the second center part P2 of the outer end face of the second button head 18 in the second button 17.

As illustrated in FIGS. 4 to 6, the first to third buttons 12, 17 and 22 in this embodiment are disposed so that first to third inner ends 15*b*, 20*b*, and 25*b* of the first to third button shafts 15, 20, and 25 protruding inward of the wristwatch case 1 are located near the inner peripheral face of the main body case 6, and these first to third inner ends 15*b*, 20*b*, and 25*b* of the first to third button shafts 15, 20 and 25 are at a substantially same height in the vertical direction.

As illustrated in FIG. 2, these first to third buttons 12, 17, and 22 are disposed side by side on the lateral face of the wristwatch case 1 while having mutually spaced angles of about 30° in plan view. This means that the first to third buttons 12, 17, and 22 are disposed radially in plan view so that the outer end faces of the first to third button heads 13, 18, and 23 are in the directions from a center part of the wristwatch case 1 toward the 2 o'clock, the 3 o'clock, and the 4 o'clock positions, respectively, at the lateral part of the wristwatch case 1.

With this configuration, as shown in FIGS. 2 and 3, while the first to third buttons 12, 17 and 22 have a narrow space between the first to third inner ends 15*b*, 20*b*, and 25*b* of the first to third button shafts 15, 20, and 25 in plan view, they have a wider space between the first to third center parts P1, P2, and P3 of the first to third button heads 13, 18, and 23. This means that the first to third buttons 12, 17 and 22 are disposed so that a user does not put their fingertip at a position across two or more button heads of the first to third button heads 13, 18, and 23.

Next, the following describes the advantageous effects of such first to third button devices 3*a* to 3*c* in the wristwatch.

Typically a user wears the wristwatch on their left arm for use. In this state, the first to third button devices 3*a* to 3*c* are placed from the 2 o'clock position to the 4 o'clock position of the wristwatch case 1, so that when the user sees the time information displayed on the wristwatch, these first to third button devices 3*a* to 3*c* are located at a position that is unlikely covered with the cuff of the user's clothes. The user therefore can easily operate the first to third button devices 3*a* to 3*c* while seeing the time information.

In this case, when the user operates the first to third button devices 3*a* to 3*c* with the right hand while seeing the time information, the 12 o'clock side of the wristwatch case 1 is away from the user's body, and the 6 o'clock side of the wristwatch case 1 is closer to the user's body. This means that the user operates the first button device 3*a* at the 2 o'clock position of the wristwatch case 1 most easily, and the operability of the third button device 3*c* at the 3 o'clock position of the wristwatch case 1 is the second. The second button device 3*b* at the 4 o'clock position of the wristwatch case 1 is slightly harder to operate than the third button device 3*c* at the 3 o'clock position.

That is, the first button device 3*a* is located at the 2 o'clock position of the wristwatch case 1, and so a user wearing the wristwatch case 1 on the left arm easily places a fingertip of the right hand on the first button 12 of the first button device 3*a* among the first through third button devices 3*a* to 3*c* to operate the first button device 3*a*. The first button device 3*a* in this embodiment is configured so that the first step portion 11*a* of the first guide protector 11 exposes the outer peripheral part of the approximately upper half of the first button head 13 of the first button 12. This configuration also allows the user to easily place a fingertip on the first button head 13.

The first button head 13 is inclined obliquely upward relative to the lateral face of the wristwatch case 1 as stated above, and this also allows the user to easily place a fingertip of the right hand on the outer end face of the first button head 13. Specifically such a first button head 13 is easy for the user to place a fingertip on the outer end face as compared with the configuration parallel to the lateral face of the wristwatch case 1.

The first button shaft 15 in this embodiment is inclined obliquely upward toward the outside relative to the lateral face of the wristwatch case 1 according to the inclination of the first button head 13 with a predetermined inclination angle, e.g., of about 15°. This enables sliding of the first button head 13 with the first button shaft 15 smoothly and favorably even in the configuration of the first button head 13 inclined obliquely upward relative to the lateral face of the wristwatch case 1, and so the first button 12 has good operability.

The first button shaft 15 is displaced downward from the center part of the inner end face of the first button head 13, and so the first button head 13 is located at an upper part of the lateral face of the wristwatch case 1. This allows the user to place a fingertip of the right hand on the outer end face of the first button head 13 more easily.

The first button head 13 in this embodiment has the first recess 13*a* on the outer end face to be recessed like an arc toward the inside of the wristwatch case 1. This allows the user to distinguish the first button head 13 with sense of a fingertip in contact with the outer end face of the first button head 13 when the fingertip comes in contact with the first recess 13*a*. Further, the small protrusion 13*b* at the center part of the first recess 13*a* allows the user to precisely know the position of the first button head 13 to place a fingertip.

Although the first button shaft 15 in this embodiment is displaced downward from the center part of the inner end face of the first button head 13, the user places a fingertip to be in contact with the small protrusion 13*b* and then presses the first center part P1 on the outer end face of the first button head 13 with the fingertip so as to guide the first button head 13 with the first button shaft 15 smoothly and favorably. This enables the first button device 3*a* to operate as the most frequently used button device.

To operate the second button device 3*b* located at the 4 o'clock position of the wristwatch case 1 among the first to third button devices 3*a* to 3*c*, the operability of the button device to place a fingertip on the button is slightly inferior to the first button device 3*a* when the user wears the wristwatch case 1 on the left arm for use. The user still easily places a fingertip of the right hand on the second button 17.

That is, when the user operates the first to third button devices 3*a* to 3*c* with the right hand while seeing the time information, the 12 o'clock position of the wristwatch case 1 is away from the user's body, and the 6 o'clock position of the wristwatch case 1 is closer to the user's body. The second button device 3*b* therefore is slightly inferior to the first button device 3*a* in the operability, but the user still easily places a fingertip of the right hand on the second button 17.

The second button device 3*b* in this embodiment also is configured so that the second step portion 16*a* of the second guide protector 16 exposes the outer peripheral part of the approximately upper half of the second button head 18 of the second button 17. Similarly to the first button head 13, this configuration also allows the user to place a fingertip on the second button head 18 easily.

Similarly to the first button head 13, the second button head 18 is inclined obliquely upward relative to the lateral face of the wristwatch case 1, and this also allows the user to easily place a fingertip of the right hand on the outer end face of the second button head 18.

Specifically such a second button head 18 is easy for the user to place a fingertip on the outer end face as compared with the configuration parallel to the lateral face of the wristwatch case 1.

Similarly to the first button shaft 15, the second button shaft 20 in this embodiment also is inclined obliquely upward toward the outside relative to the lateral face of the wristwatch case 1 according to the inclination of the second button head 18 with the predetermined inclination angle θ equal to that of the first button shaft 15, e.g., of about 15°. This enables sliding of the second button head 18 with the second button shaft 20 smoothly and favorably even in the configuration of the second button head 18 inclined obliquely upward relative to the lateral face of the wristwatch case 1, and so similarly to the first button 12, the second button 17 has good operability.

The second button shaft 20 is located at the center part of the inner end face of the second button head 18. The user therefore presses any place of the outer end face of the second button head 18 to make the second button shaft 20 guide the second button head 18 favorably, so that the second button head 18 slides smoothly and favorably.

The second button 17 in this embodiment is located at the center part of the inner end face of the second button head 18, and so the first button head 13 and the second button head 18 are different in position on the lateral part of the wristwatch case 1 in the vertical direction and in the radial direction. This allows the user to distinguish between the first button head 13 and the second button head 18 with their different positions.

Similarly to the first recess 13*a* of the first button head 13, the second button head 18 in this embodiment has the second recess 18*a* on the outer end face to be recessed like an arc toward the inside of the wristwatch case 1. This allows the user to easily distinguish the second button head 18 with sense of a fingertip in contact with the outer end face of the second button head 18 when the fingertip comes in contact with the second recess 18*a*.

To operate the third button device 3*c* among the first to third button devices 3*a* to 3*c*, the user wearing the wristwatch case 1 on the left arm places a fingertip of the right hand on the third button 22 more easily than on the second button device 3*b* at the 4 o'clock position, because the third button device 3*c* is located at the 3 o'clock position of the wristwatch case 1.

That is, when the user operates the first to third button devices 3*a* to 3*c* with the right hand while seeing the time information, the 12 o'clock position of the wristwatch case 1 is away from the user's body, and the 6 o'clock position of the wristwatch case 1 is closer to the user's body. The third button device 3*c* therefore is slightly inferior to the first button device 3*a* in the operability, but the user places a fingertip of the right hand on the third button 22 more easily than in the second button device 3*b*.

In the third button device 3*c* in this embodiment, the third button head 23 of the third button 22 has an outer diameter smaller than those of the first and second button heads 13 and 18. When the user places a fingertip of the right hand on the third button 22, the operability is slightly inferior to the first and second button devices 3*a* and 3*b*. In this respect, the third button device 3*c* is configured so that the third step portion 21*a* of the third guide protector 21 exposes the outer peripheral part of the approximately upper half of the third button head 23 of the third button 22. Similarly to the first button head 13 and the second button head 18, this configuration allows the user to place a fingertip on the third button head 23 easily.

In this way, the third button head 23 is placed substantially parallel to the lateral face of the wristwatch case 1, so that the direction of the third button head 23 is different from the first and second button heads 13 and 18. When the user places a fingertip of the right hand on the third button head 23, this configuration allows the user to distinguish between the third button head 23 and the first and second button head 13 and 18 with their different directions (inclinations).

The third button shaft 25 in this embodiment is placed substantially orthogonal to the lateral face of the wristwatch case 1. When a user presses the third button head 23, which is substantially parallel to the lateral face of the wristwatch case 1, in the direction substantially orthogonal to the lateral face of the wristwatch case 1, the third button shaft 25 guides the third button head 23 smoothly and favorably, and so the third button 22 has good operability.

The third button shaft 25 is displaced downward from the center part of the inner end face of the third button head 23, and so as compared with the configuration having the third button shaft 25 placed at the center part of the inner end face of the third button head 23, the third button head 23 is located at an upper part of the lateral face of the wristwatch case 1 similarly to the first button device 3*a*. Similarly to the first button device 3*a*, this allows the user to place a fingertip of the right hand on the outer end face of the third button head 23 easily. This improves the operability of the third button device 3*c*.

The first to third buttons 12, 17 and 22 in this embodiment have the first to third center parts P1 to p3 on their outer end faces of the first to third button heads 13, 18, and 23 that are displaced on the lateral part of the wristwatch case 1 in the vertical direction and in the radial direction. Such displacement of the first to third center parts P1 to P3 allows the user to distinguish each of the first to third button heads 13, 18 and 23.

The first to third buttons 12, 17 and 22 are disposed so that their first to third inner ends 15*b*, 20*b*, and 25*b* of the first to third button shafts 15, 20, and 25 protruding inward of the wristwatch case 1 are located near the inner peripheral face of the main body case 6, and these first to third inner ends 15*b*, 20*b*, and 25*b* are at a same height in the wristwatch case 1. This allows all of the first to third buttons 12, 17 and 22 to connect to their corresponding switch contacts (not illustrated) in the watch module in the wristwatch case 1 in response to the pressing operation, and enables favorable switching operation.

These first to third buttons 12, 17, and 22 are disposed side by side on the lateral face of the wristwatch case 1 while having mutually spaced angles of about 30° in plan view. This means that the user does not place one fingertip of the right hand across two or more buttons of the first to third buttons 12, 17 and 22. That is, the outer end faces of the first to third button heads, 13, 18, and 23 of the first to third buttons 12, 17, and 22 are disposed radially in plan view in the direction from the center part of the wristwatch case 1 to the 2 o'clock, the 3 o'clock, and the 4 o'clock positions, respectively, of the lateral part of the wristwatch case 1.

With this configuration, while the first to third buttons 12, 17 and 22 have a narrow space between the first to third inner ends 15*b*, 20*b*, and 25*b* of the first to third button shafts 15, 20, and 25, they have a wider space between the first to third center parts P1, P2, and P3 of the first to third button heads 13, 18, and 23. The user places a fingertip on these first to third button heads 13, 18 and 23 having wider spaces, and this prevents the user from erroneously placing a fingertip on two or more button heads of the first to third button heads 13, 18, and 23, and so prevents erroneous operation of the first to third buttons 12, 17, and 22.

As stated above, the first button device 3*a* in the wristwatch includes the substantially cylindrical first guide protector 11 protruding from the lateral face of the wristwatch case 1, and the first button 12 disposed in the first guide protector 11 so as to be slidable inward and outward of the wristwatch case 1. The first button 12 includes the first button head 13 disposed in the first guide protector 11, and the first button shaft 15 passing through the first through hole 14 of the wristwatch case 1. The first button head 13 is inclined obliquely upward relative to the lateral face of the wristwatch case 1, and this prevents accidental and erroneous operation of the button and so improves the operability of the button.

In this way, the first button device 3*a* of the wristwatch is configured so that the first button head 13 of the first button 12 is disposed in the substantially cylindrical first guide protector 11 protruding from the lateral face of the wristwatch case 1 to be slidable inward and outward of the wristwatch case 1. The first guide protector 11 therefore favorably protects the outer periphery of the first button head 13, and so avoids accidentally hitting of the outer periphery of the first button head 13 by an object and pressing of the first button head 13, and prevents accidental and erroneous operation of the first button 12.

The first button device 3*a* of the wristwatch is configured so that the first button head 13 of the first button 12 is inclined obliquely upward relative to the lateral face of the wristwatch case 1. This allows the user to place a fingertip on the outer end face of the first button head 13 more easily than in the configuration of the button head that is parallel to the lateral face of the wristwatch case 1, and so improves the operability of the first button 12.

Similarly, the second button device 3*b* in the wristwatch includes the substantially cylindrical second guide protector 16 protruding from the lateral face of the wristwatch case 1, and the second button 17 disposed in the second guide protector 16 so as to be slidable inward and outward of the wristwatch case 1. The second button 17 includes the second button head 18 disposed in the second guide protector 16, and the second button shaft 20 passing through the second through hole 19 of the wristwatch case 1. The second button head 18 is inclined obliquely upward relative to the lateral face of the wristwatch case 1, and similarly to the first button device 3*a*, this prevents accidental and erroneous operation of the button and so improves the operability of the button.

In this way, the second button device 3*b* of the wristwatch is configured so that the second button head 18 of the second button 17 is disposed in the substantially cylindrical second guide protector 16 protruding from the lateral face of the wristwatch case 1 to be slidable inward and outward of the wristwatch case 1. Similarly to the first button device 3*a*, the second guide protector 16 therefore favorably protects the outer periphery of the second button head 18, and so avoids accidentally hitting of the outer periphery of the second button head 18 by an object and pressing of the second button head 18, and prevents accidental and erroneous operation of the second button 17.

The second button device 3*b* of the wristwatch is configured so that the second button head 18 of the second button 17 is inclined obliquely upward relative to the lateral face of the wristwatch case 1. Similarly to the first button device 3*a*, this allows the user to place a fingertip on the outer end face of the second button head 18 more easily than in the configuration of the button head that is parallel to the lateral face of the wristwatch case 1, and so improves the operability of the second button 17.

The first and second button devices 3*a* and 3*b* of the wristwatch are configured so that the first and second guide protectors 11 and 16 have the first and second step portions 11*a* and 16*a*, respectively, and an upper half of each guide protector protrudes less than the lower half on the lateral face of the wristwatch case 1. These first and second step portions 11*a* and 16*a* allow the user to place a fingertip on the first and second button heads 13 and 18 easily while protecting the outer periphery of the first and second button heads 13 and 18 with the first and second guide protectors 11 and 16. This also improves the operability of these button devices.

The first and second button devices 3*a* and 3*b* of the wristwatch are configured so that the first and second buttons 12 and 17 have the first and second recesses 13*a* and 18*a* on the outer end faces so as to be recessed like an arc toward the inside of the wristwatch case 1. This allows the user to easily distinguish the first or second button head 13 and 18 with sense of a fingertip in contact with the outer end face of the first or second button head 13 or 18 when the fingertip comes in contact with the first or second recess 13*a* and 18*a*. This also improves the operability of these button devices.

The first button device 3*a* in this embodiment has the small protrusion 13*b* at the center part in the first recess 13*a* of the first button head 13 to let the user know the position to place a fingertip. This small protrusion 13*b* allows the user to precisely know the contact position with a fingertip relative to the first button head 13. This configuration also improves the operability of the button device more.

The first and second button devices 3*a* and 3*b* of the wristwatch are configured so that the first and second button shafts 15 and 20 of the first and second buttons 12 and 17 are inclined obliquely upward to the outside relative to the lateral face of the wristwatch case 1 according to the inclination of the first and second button heads 13 and 18 with predetermined inclination angle θ. This allows the first and second button shafts 15 and 20 to smoothly and favorably guide the first and second button heads 13 and 18 that are inclined obliquely upward relative to the lateral face of the wristwatch case 1. This enables favorable sliding of the first and second button head 13 and 18 and so improves the operability of these button devices.

The first button device 3*a* of the wristwatch is configured so that the first button shaft 15 is located at a place other than the center part of the inner end face of the first button head 13. Specifically the first button shaft 15 of the present embodiment is displaced downward from the center part of the inner end face of the first button head 13. This allows the first button head 13, which is inclined relative to the lateral face of the wristwatch case 1, to be placed at an upper part of the lateral face of the wristwatch case 1, and so allows the user to place a fingertip on the outer end face of the first button head 13 more easily.

Although the first button shaft 15 of the first button device 3*a* is displaced downward from the center part of the inner end face of the first button head 13, the small protrusion 13*b* at the center part in the first recess 13*a* of the first button head 13 allows the user to know the position of the first button head 13 to place a fingertip, and so to press a center part of the first button head 13. This enables favorable guiding of the first button head 13 with the first button shaft 15, and this configuration also improves the operability of the button device.

The second button device 3*b* of the wristwatch is configured so that the second button shaft 20 is located at the center part of the inner end face of the second button head 18. The user therefore presses any place of the outer end face of the second button head 18, which is inclined relative to the lateral face of the wristwatch case 1, to let the second button shaft 20 guide the second button head 18 favorably. This enables smooth and favorable sliding of the second button head 18, and so improves the operability of the button device.

This wristwatch includes the first button device 3*a* and the second button device 3*b*, and these first and second button devices 3*a* and 3*b* include the first and second guide protectors 11 and 16, respectively, that are disposed side by side on the lateral face of the wristwatch case 1, and also include the first button 12 disposed to be slidable in the first guide protector 11 and the second button 17 having the same size of the first button 12 and disposed to be slidable in the second guide protector 16, respectively. Although the first button 12 and the second button 17 are disposed side by side on the lateral part of the wristwatch case 1, this configuration avoids accidental and erroneous operation of the button devices and improves the operability of the button devices.

That is, the first button device 3*a* of the wristwatch is configured so that the first button head 13 of the first button 12 is disposed in the substantially cylindrical first guide protector 11 protruding from the lateral face of the wristwatch case 1 to be slidable inward and outward of the wristwatch case 1. Although the first button 12 and the second button 17 are disposed side by side on the lateral part of the wristwatch case 1, the first guide protector 11 favorably protects the outer periphery of the first button head 13.

In this way although the first button 12 and the second button 17 are disposed side by side on the lateral part of the wristwatch case 1, the first button device 3*a* of the wristwatch is configured so as to avoid accidentally hitting of the outer periphery of the first button head 13 by an object and pressing of the first button head 13, and prevents accidental and erroneous operation of the first button 12. Additionally the user is allowed to correctly and favorably press the first button 12 only, even in the configuration of the first button 12 and the second button 17 disposed side by side on the lateral part of the wristwatch case 1.

Similarly, the second button device 3*b* of the wristwatch is configured so that the second button head 18 of the second button 17 is disposed in the substantially cylindrical second guide protector 16 protruding from the lateral face of the wristwatch case 1 to be slidable inward and outward of the wristwatch case 1. Although the first button 12 and the second button 17 are disposed side by side on the lateral part of the wristwatch case 1, the second guide protector 16 favorably protects the outer periphery of the second button head 18.

In this way although the first button 12 and the second button 17 are disposed side by side on the lateral part of the wristwatch case 1, the second button device 3*b* of the wristwatch is configured so as to avoid accidentally hitting of the outer periphery of the second button head 18 by an object and pressing of the second button head 18, and prevents accidental and erroneous operation of the second button 17. Additionally the user is allowed to correctly and favorably press only the second button 17 having the same size of the first button 12, even in the configuration of the first button 12 and the second button 17 disposed side by side on the lateral part of the wristwatch case 1.

The first and second button devices 3*a* and 3*b* of the wristwatch are configured so that both of the first and second button heads 13 and 18 of the first and second buttons 12 and 17 are inclined obliquely upward relative to the lateral face of the wristwatch case 1. This allows the user to place a fingertip on the outer end face of the first or the second button head 13 or 18 more easily than in the configuration of the button head that is parallel to the lateral face of the wristwatch case 1, and so improves the operability of these buttons 12 and 17, even in the configuration having the first and second buttons 12 and 17 disposed side by side on the lateral part of the wristwatch case 1.

The first and second button devices 3*a* and 3*b* of the wristwatch are configured so that the first button shaft 15 of the first button 12 is located at a place other than the center part of the inner end face of the first button head 13. The first button shaft 15 of the first button 12 in this example is displaced downward from the center part of the inner end face of the first button shaft 13, and the second button shaft 20 of the second button 17 is disposed at the center part of the inner end face of the second button head 18. This allows the first button head 13 to be located above the second button head 18 on the lateral part of the wristwatch case 1, and also allows the first and second button shafts 15 and 20 to favorably guide the first and second button heads 13 and 18, respectively. This improves the operability of the first and second buttons 12 and 17, even in the configuration of the first and second buttons 12 and 17 disposed side by side on the lateral part of the wristwatch case 1.

The first and second button devices 3*a* and 3*b* of the wristwatch are configured so that the first button shaft 15 is displaced downward from the center part of the inner end face of the first button head 13 and the second button shaft 20 is disposed at the center part of the inner end face of the second button head 18. This configuration therefore places the first button head 13 above the second button head 18 on the lateral face of the wristwatch case 1.

With this configuration, the first and second button devices 3*a* and 3*b* of the wristwatch are configured so as to displace the position of the first and second center parts P1 and P2 of the outer end faces of the first and second button heads 13 and 18 in the vertical direction and in the radial direction. This allows the user to easily distinguish the first or second button head 13 and 18 due to such a displacement between the first and second center parts P1 and P2 in the vertical direction and in the radial direction.

Specifically the first button device 3*a* and the second button device 3*b* of the wristwatch are configured so that the first center part P1 of the outer end face of the first button head 13 in the first button 12 is located above the second center part P2 of the outer end face of the second button head 18 in the second button 17 on the lateral face of the wristwatch case 1. When the user places a fingertip to the outer end face of the first button head 13 and to the outer end face of the second button head 18, the user is allowed to distinguish between the first button head 13 and the second button head 18 due to their positional difference in the vertical direction and in the radial direction on the lateral face of the wristwatch case 1.

This wristwatch includes the first button device 3*a* and the third button device 3*c*, and these first and third button devices 3*a* and 3*c* include the first and third guide protectors 11 and 21, respectively, that are disposed side by side on the lateral face of the wristwatch case 1, and also include the first button 12 disposed to be slidable in the first guide protector 11 and the third button 22 having a size smaller than the outer diameter of the first button 12 and disposed to be slidable in the third guide protector 21, respectively. Although the first button 12 and the third button 22 are disposed side by side on the lateral part of the wristwatch case 1, this configuration allows the user to distinguish between the first and the third buttons 12 and 22 due to their sizes, and also avoids accidental and erroneous operation of the button devices and improves the operability of the button devices.

That is, the first button device 3*a* of the wristwatch is configured so that the first button head 13 of the first button 12 is disposed in the substantially cylindrical first guide protector 11 protruding from the lateral face of the wristwatch case 1 to be slidable inward and outward of the wristwatch case 1. Although the first button 12 and the third button 22 are disposed side by side on the lateral part of the wristwatch case 1, the first guide protector 11 favorably protects the outer periphery of the first button head 13.

In this way although the first button 12 and the third button 22 are disposed side by side on the lateral part of the wristwatch case 1, the first button device 3*a* of the wristwatch is configured so as to avoid accidentally hitting of the outer periphery of the first button head 13 by an object and pressing of the first button head 13, and prevents accidental and erroneous operation of the first button 12. Additionally the user is allowed to correctly and favorably press the first button 12 only, even in the configuration of the first button 12 and the third button 22 disposed side by side on the lateral part of the wristwatch case 1.

Similarly, the third button device 3*c* of the wristwatch is configured so that the third button head 23 of the third button 22 is disposed in the substantially cylindrical third guide protector 21 protruding from the lateral face of the wristwatch case 1 to be slidable inward and outward of the wristwatch case 1. Although the first button 12 and the third button 22 are disposed side by side on the lateral part of the wristwatch case 1, the third guide protector 21 favorably protects the outer periphery of the third button head 23.

In this way, although the first button 12 and the third button 22 are disposed side by side on the lateral part of the wristwatch case 1, the third button device 3*c* of the wristwatch is configured so as to avoid accidentally hitting of the outer periphery of the third button head 23 by an object and pressing of the third button head 23, and prevents accidental and erroneous operation of the third button 22. Additionally the user is allowed to correctly and favorably press only the third button 22 having a size smaller than the outer diameter of the first button 12, even in the configuration of the first button 12 and the third button 22 disposed side by side on the lateral part of the wristwatch case 1.

The first and third button devices 3*a* and 3*c* of the wristwatch are configured so that the outer end face of the first button head 13 of the first button 12 is inclined obliquely upward relative to the lateral face of the wristwatch case 1 and the outer end face of the third button head 23 of the third button 22 is disposed parallel to the lateral face of the wristwatch case 1. This allows the user to press the first button head 13 from obliquely above on the lateral part of the wristwatch case 1 and to press the third button 23 in the direction orthogonal to the lateral part of the wristwatch case 1, where the first button 12 and the third button 22 are disposed side by side on the lateral part of the wristwatch case 1. This improves the operability with the first and third button heads 13 and 23.

The first and third button devices 3*a* and 3*c* of the wristwatch are configured so that the outer end face of the first button head 13 of the first button 12 is inclined obliquely upward relative to the lateral face of the wristwatch case 1 and the outer end face of the third button head 23 of the third button 22 is disposed substantially parallel to the lateral face of the wristwatch case 1. In this way, the first and third button heads 13 and 23 are different in inclination relative to the lateral face of the wristwatch case 1, and this allows the user to distinguish between the first button head 13 and the third button head 23 with their different inclinations.

That is, according to the first and third button devices 3*a* and 3*c* of the wristwatch, when the user places a fingertip to the outer end face of the first button head 13 or the third button head 23, the user is allowed to distinguish between the first button head 13 and the third button head 23 with a fingertip due to their difference in inclination, even in the configuration of the first and third buttons 12 and 22 disposed side by side on the lateral part of the wristwatch case 1.

The first and third button devices 3*a* and 3*c* of the wristwatch are configured so that the first button shaft 15 of the first button 12 is inclined obliquely upward to the outside relative to the lateral face of the wristwatch case 1 with a predetermined inclination angle θ, and the third button shaft 25 of the third button 22 is orthogonal to the lateral face of the wristwatch case 1. This allows the user to favorably operate the first button 15 and the third button 22 that are disposed side by side on the lateral part of the wristwatch case 1 and distinguish between the first and third button heads 13 and 23 with a fingertip.

Specifically the first button device 3*a* of the wristwatch is configured so that the first button shaft 15 of the first button 12 is inclined obliquely upward toward the outside relative to the lateral face of the wristwatch case 1 with a predetermined inclination angle θ. The first button shaft 15 guides the first button head 13, which is inclined obliquely upward relative to the lateral face of the wristwatch case 1, to slide smoothly and favorably. This enables favorable sliding of the first button head 13 even in the configuration of the first and third buttons 12 and 22 disposed side by side on the lateral part of the wristwatch case 1, and so improves the operability of the button devices.

The third button device 3*c* of the wristwatch is configured so that the third button shaft 25 is disposed substantially orthogonal to the lateral face of the wristwatch case 1. When the user presses the third button head 23, which is disposed substantially parallel to the lateral face of the wristwatch case 1, in the direction orthogonal to the lateral part of the wristwatch case 1, the third button shaft 25 smoothly and favorably guides the third button head 23. This enables favorable sliding of the third button head 23 even in the configuration of the first and third buttons 12 and 22 disposed side by side on the lateral part of the wristwatch case 1, and so improves the operability of the button devices.

The first button device 3*a* and the third button device 3*c* of the wristwatch are configured so that the first button shaft 15 of the first button 12 and the third button shaft 25 of the third button 22 are located at places other than the center parts of the inner end faces of the first and third button heads 13 and 23, respectively. These button shafts are displaced downward from the center parts of the inner end faces of the first and third button heads 13 and 23, and so as compared with the configuration having the first button shaft and the third button shaft placed at the center parts of the inner end faces of the button heads 13 and 23, respectively, this allows the first button head 13, which is inclined relative to the lateral face of the wristwatch case 1, and the third button head 23 to be placed at an upper part of the lateral face of the wristwatch case 1.

The first and third button devices 3*a* and 3*c* of the wristwatch are configured so as to allow the user to easily place a fingertip on the outer end faces of the first button head 13 and the third button head 23 of the first button 12 and the third button 22, which are disposed side by side on the lateral part of the wristwatch case 1, and so this configuration improves the operability of the first button 12 and the third button 22.

The first and third button devices 3*a* and 3*c* of the wristwatch are configured so that the first center part P1 of the outer end face of the first button head 13 is located above the third center part P3 of the outer end face of the third button head 23 on the lateral face of the wristwatch case 1. This allows the user to distinguish between the first and third button heads 13 and 23 due to their vertical positional difference on the lateral face of the wristwatch case 1 when placing a fingertip on the outer end face of the first button head 13 or the third button head 23.

This wristwatch includes the first to third button devices 3*a* to 3*c*, and these first to third button devices 3*a* to 3*c* include the first to third guide protectors 11, 16, 21 respectively, that are disposed side by side on the lateral face of the wristwatch case 1, and also include the first to third buttons 12, 17, and 22 disposed to be slidable in the first to third guide protectors 11, 16, and 21, respectively. Although the first to third buttons 12, 17, 22 are disposed side by side on the lateral part of the wristwatch case 1, this configuration avoids accidental and erroneous operation of the first to third buttons 12, 17, and 22 and improves the operability of the button devices.

The first to third button devices 3*a* to 3*c* of the wristwatch in this embodiment are configured so that the first and second guide protectors 11 and 16 have the same inner diameter, the third guide protector 21 is disposed between the first and second guide protectors 11 and 16, and the inner diameter of the third guide protector 21 is smaller than the inner diameters of the first and second guide protectors 11 and 16. Although the first to third buttons 12, 17, and 22 are disposed side by side on the lateral part of the wristwatch case 1, the user is allowed to distinguish between the first to third buttons 12, 17, and 22 when placing a fingertip on each outer end face of the first to third buttons 12, 17, and 22.

That is, the first to third button devices 3*a* to 3*c* of the wristwatch are configured so that the user is allowed to distinguish between the first to third buttons 12, 17, and 22, which are disposed side by side on the lateral part of the wristwatch case 1, due to the positions of the first to third buttons 12, 17, and 22 and the shapes of the first to third buttons 12, 17, and 22 when the user places a fingertip to each outer end face of the first to third buttons 12, 17, 22.

The first to third button devices 3*a* to 3*c* of the wristwatch are configured so that the first button head 13 of the first button 12 and the second button head 18 of the second button 17 have the outer diameter of the same size and are inclined obliquely upward relative to the lateral face of the wristwatch case 1, and the third button head 23 of the third button 22 has the outer diameter smaller than that of the first and second buttons 12 and 17 and is disposed substantially parallel to the lateral face of the wristwatch case 1. This configuration allows the user to distinguish between the first to third button heads 13, 18 and 23 when placing a fingertip on the first to third button heads 13, 18, and 23.

That is, the first to third button devices 3*a* to 3*c* of the wristwatch include the first to third buttons 12, 17, and 22 disposed side by side on the lateral part of the wristwatch case 1, and are configured so that the user is allowed to distinguish between the first to third button heads 13, 18, and 23 due to the inclinations of the first to third button heads 13, 18, and 23 and the shapes, i.e. the size of the first to third button heads 13, 18, and 23 when the user places a fingertip to each outer end face of the first to third button heads 13, 18, and 23.

The first to third button devices 3*a* to 3*c* of the wristwatch are configured so that the first and second button shafts 15 and 20 of the first and second buttons 12 and 17 are inclined obliquely upward to the outside with a predetermined inclination angle θ relative to the lateral face of the wristwatch case 1, the first button shaft 15 is located at a place other than the center part of the inner end face of the first button head 13. The first button shaft 15 of the present embodiment is displaced downward from the center part of the inner end face of the first button head 13, and the second button shaft 20 is located at the center part of the inner end face of the second button head 18. In this way, the vertical position on the lateral part of the wristwatch case 1 differs between the first and second button head 13 and 18, and this allows the user to distinguish between the first and second button heads 13 and 18.

The first to third button devices 3*a* to 3*c* of the wristwatch are configured so that the third button shaft 25 is disposed substantially orthogonal to the lateral face of the wristwatch case 1, and the third button head 23 is accordingly disposed substantially parallel to the lateral face of the wristwatch case 1. This allows the user to distinguish between the first and second button heads 13 and 18 and the third button head 23 due to a difference in inclination between the third button head 23 and the first and second button heads 13 and 18.

The first to third button devices 3*a* to 3*c* of the wristwatch are configured so that the third button shaft 25 is located at a place other than the center part of the inner end face of the third button head 23. The third button shaft 25 of the present embodiment is displaced downward from the center part of the inner end face of the third button head 23, and this makes the vertical position on the lateral face of the wristwatch case 1 of the third button head 23 different from that of the first and second button heads 13 and 18. The user is therefore allowed to distinguish between the first and second button heads 13 and 18 and the third button shaft 23 also due to a difference in vertical position between the third button head 23 and the first and second button heads 13 and 18.

The first to third button devices 3*a* to 3*c* of the wristwatch are configured about the first to third center parts P1 to P3 of the outer end faces of the first to third button heads 13, 18, and 23 so that the first center part P1 of the first button head 13 is located above the second center part P2 of the second button head 18 on the lateral face of the wristwatch case 1 and the third center part P3 of the third button head 23 is located below the second center part P2 of the second button head 18 on the lateral face of the wristwatch case 1. This configuration allows the user to distinguish between the first to third button heads 13, 18 and 23 due to a difference in position in the vertical direction and the radial direction of the first to third center parts P1 to P3 when placing a fingertip on each outer end face of the first to third button heads 13, 18, and 23.

The wristwatch case 1 of the wristwatch has a substantially round shape, and the first to third button devices 3*a* to 3*c* include the first to third buttons 12, 17, and 22 and the first to third guide protectors 11, 16, and 21 that are disposed side by side while having mutually spaced angles of about 30° in plan view. The user therefore is allowed to distinguish between the first and third button heads 13, 18, and 23 that are different in orientation due to the opening angles of the first to third buttons 12, 17, and 22 that are disposed side by side together with the first to third guide protectors 11, 16, and 21 on the lateral face of the wristwatch case 1.

That is, the first to third buttons 12, 17, and 22 are disposed radially in plan view so that their outer end faces of the first to third button heads 13, 18, and 23 are directed in the directions from the center part of the wristwatch case 1 to the 2 o'clock position, the 3 o'clock position, and the 4 o'clock position, respectively, of the lateral part of the wristwatch case 1. This differentiates the first to third button heads 13, 18, and 23 in orientation, and so the user is allowed to distinguish the first to third button heads 13, 18, and 23 due to their different orientations.

With this configuration, while the first to third buttons 12, 17 and 22 have a narrow space between the first to third inner ends 15*b*, 20*b*, and 25*b* of the first to third button shafts 15, 20, and 25, they have a wider space between the first to third center parts P1, P2, and P3 of the first to third button heads 13, 18, and 23. This prevents the user from erroneously placing a fingertip on two or more button heads of the first to third button heads 13, 18, and 23, allows the user to operate these first to third buttons 12, 17, and 22 individually with a fingertip, and so prevents erroneous operation of the first to third buttons 12, 17, and 22.

The first to third button devices 3*a* to 3*c* of the wristwatch are disposed from the 2 o'clock position to the 4 o'clock position of the wristwatch case 1, so that when the user sees the time information displayed on the wristwatch, these first to third button devices 3*a* to 3*c* are located at a position that is unlikely covered with the cuff of the user's clothes. The user therefore can easily operate the first to third button devices 3*a* to 3*c* while seeing the time information.

When the user operates the first to third button devices 3*a* to 3*c* with the right hand while seeing the time information, the 12 o'clock side of the wristwatch case 1 is away from the user's body, and the 6 o'clock side of the wristwatch case 1 is closer to the user's body. This means that the user operates the first button device 3*a* at the 2 o'clock position of the wristwatch case 1 most easily, and the operability of the third button device 3*c* at the 3 o'clock position of the wristwatch case 1 is the second.

The above embodiment describes the example where the first button device 3*a* is disposed at the 2 o'clock position of the wristwatch case 1, the second button device 3*b* is disposed at the 4 o'clock position, and the third button device 3*c* is disposed at the 3 o'clock position. In another embodiment, these first to third button devices 3*a* to 3*c* may be disposed in any order in the range from the 2 o'clock to the 4 o'clock.

The above embodiment describes the example where the third button head 23 of the third button device 3*c* is disposed substantially parallel to the lateral part of the wristwatch case 1. In another embodiment, the third button head 23 of the third button device 3*c* may be inclined relative to the lateral part of the wristwatch case 1.

The above embodiment describes the example where the first to third center parts P1 to P3 of the first to third button heads 13, 18, and 23 in the first to third button devices 3*a* to 3*c* have different vertical positions. In another embodiment, the first to third center parts P1 to P3 of the first to third button heads 13, 18, and 23 may be at the same vertical position, or the first to third center parts P1 to P3 each may be at any vertical position in the first to third button heads 13, 18, and 23.

The above embodiment describes the example where the first and second button heads 13 and 18 and the third button head 23 are different in size. In another embodiment, all of the first to third button heads 13, 18, and 23 may have different sizes or may have the same size. The first to third button heads 13, 18 and 23 do not have to be round, and may be polygonal, such as quadrangle or pentagon, or oval. All of the first to third button heads 13, 18, and 23 may be different in shape.

The above embodiment describes the example where the first to third guide protectors 11, 16, and 21 have a substantially cylindrical shape. In another embodiment, they may have an angular tube shape having a polygonal shape, such as quadrangle or pentagon, in cross section, or may have an tubular shape having an oval shape in cross section.

The above embodiment describes the example of a wristwatch. In another embodiment, the present invention may be used to various types of timepieces other than the wristwatch, including a travel watch, an alarm clock, a table clock, and a wall clock. The present invention is not limited to necessarily a timepiece, and can be widely applied to electronic devices, such as mobile communication devices and personal digital assistances.

That is the descriptions on one embodiment of the present invention. The present invention is not limited to this embodiment, and includes the invention recited in the claims and an equivalent range thereof.

What is claimed is:

1. A button device comprising:

a case having a lateral face and a guide protector protruding from the lateral face of the case; and a button disposed in the guide protector to be slidable, the button including:

a button head disposed in the guide protector; and a button shaft passing through a hole in the case, the button head being inclined obliquely upward relative to the lateral face of the case, wherein the button shaft of the button is located at a position that is displaced downward from a center part of an inner end face of the button head.

2. The button device according to claim 1, wherein the guide protector has a step between an upper part and a lower part of the guide protector, the step being configured so that the upper part protrudes less than the lower part from the lateral face of the case.

3. The button device according to claim 1, wherein the button has a recess on an outer end face of the button head, the recess being recessed in an arc shape toward inside of the case.

4. The button device according to claim 1, wherein the button shaft of the button is inclined obliquely upward toward outside relative to the lateral face of the case with a predetermined inclination angle.

5. The button device according to claim 1, further comprising:

a second guide protector; and a second button disposed in the second guide protector to be slidable, wherein the second button includes:

a second button head disposed in the second guide protector; and a second button shaft passing through a second hole in the case, wherein the second button shaft of the second button is located at a center part of an inner end face of the second button head.

6. A button device comprising:

a case having a lateral face and a first guide protector protruding from the lateral face of the case;

a first button disposed in the first guide protector to be slidable, the first button including:

a first button head disposed in the guide protector; and a first button shaft passing through a first hole in the case, the first button head being inclined obliquely upward relative to the lateral face of the case; and a second guide protector, wherein:

the first guide protector and the second guide protector are disposed side by side on the lateral face of the case, in the second guide protector, a second button having a substantially same size as the first button is disposed to be slidable, and the second button includes a second button head disposed in the second guide protector, and a second button shaft passing through a second hole of the case.

7. The button device according to claim 6, wherein both of the first button head of the first button and the second button head of the second button are inclined obliquely upward relative to the lateral face of the case.

8. The button device according to claim 6, wherein:

the first button shaft of the first button is located at a position that is displaced from a center part of an inner end face of the first button head, and the second button shaft of the second button is disposed at a center part of an inner end face of the second button head.

9. The button device according to claim 6, wherein a center part of an outer end face of the first button head and a center part of an outer end face of the second button head are vertically displaced on the lateral face of the case.

10. The button device according to claim 1, wherein:

the guide protector is a first guide protector, the button is a first button, the button head is a first button head, and the button shaft is a first button shaft, the button device further comprises a third guide protector, the first guide protector and the third guide protector are disposed side by side on the lateral face of the case, in the third guide protector, a third button having an outer diameter smaller than an outer diameter of the first button is disposed to be slidable, and the third button includes a third button head disposed in the third guide protector, and a third button shaft passing through a third hole of the case.

11. The button device according to claim 10, wherein:

the first button head of the first button has an outer end face that is inclined obliquely upward relative to the lateral face of the case, and the third button head of the third button has an outer end face that is substantially parallel to the lateral face of the case.

12. The button device according to claim 10, wherein:

the first button shaft of the first button is inclined obliquely upward toward outside relative to the lateral face of the case with a predetermined inclination angle, and the third button shaft of the third button is substantially orthogonal to the lateral face of the case.

13. The button device according to claim 10, wherein:

the third button shaft of the third button is located at a position that is displaced from a center part of an inner end face of the third button head, and a center part of an outer end face of the first button head and a center part of an outer end face of the third button head are vertically displaced on the lateral face of the case.

14. The button device according to claim 1, wherein the guide protector is a first guide protector, the button is a first button, the button head is a first button head, and the button shaft is a first button shaft, the first guide protector, a second guide protector and a third guide protector are disposed side by side on the lateral face of the case, in the second guide protector, a second button is disposed to be slidable, in the third guide protector, a third button is disposed to be slidable, the second button includes a second button head disposed in the second guide protector, and a second button shaft passing through a second hole of the case, and the third button includes a third button head disposed in the third guide protector, and a third button shaft passing through a third hole of the case.

15. The button device according to claim 14, wherein:

the first guide protector and the second guide protector have inner diameters of a substantially same size, and the third guide protector is disposed between the first and second guide protectors, and has an inner diameter that is smaller than the inner diameters of the first and second guide protectors.

16. The button device according to claim 14, wherein:

the first button head of the first button and the second button head of the second button have outer diameters of a substantially same size and are inclined obliquely upward relative to the lateral face of the case, and the third button head of the third button has an outer diameter smaller than the outer diameters of the first and second buttons, and is substantially parallel to the lateral face of the case.

17. The button device according to claim 14, wherein:

the first button shaft of the first button is inclined obliquely upward toward outside relative to the lateral face of the case with a predetermined inclination angle, the second button shaft of the second button is inclined obliquely upward toward outside relative to the lateral face of the case with the predetermined inclination angle, and the second button shaft is disposed at a center part of an inner end face of the second button head, and the third button shaft of the third button is substantially orthogonal to the lateral face of the case, and the third button shaft is located at a position that is displaced from a center part of an inner end face of the third button head.

18. The button device according to claim 14, wherein center parts of outer end faces of the first button head, the second button head, and the third button head are arranged relative to the center part of the second button head so that the center part of the first button head is located above the center part of the second button head on the lateral face of the case, and the center part of the third button head is located below the center part of the second button head on the lateral face of the case.

19. The button device according to claim 14, wherein the case has a substantially round shape, and the first button, the second button, the third button as well as the first guide protector, the second guide protector, and the third guide protector are disposed side by side while having mutually spaced angles of about 30° in plan view.

20. The button device according to claim 1, wherein the guide protector is disposed at a 2 o'clock or a 4 o'clock position of a timepiece when the button device is placed on the timepiece.

21. A timepiece comprising the button device according to claim 1.

* * * * *